US005915638A

United States Patent [19]

Jean

[11] Patent Number: 5,915,638

[45] Date of Patent: Jun. 29, 1999

[54] POSITIONING DEVICE FOR CONCAVES OF CONE CRUSHERS

[76] Inventor: Cheng-Shu Jean, No. 14, Chung Hsing N. St., Sanchung City, Taipei Hsien, Taiwan

[21] Appl. No.: 09/207,986

[22] Filed: Dec. 9, 1998

[51] Int. Cl.[6] ..... B02C 2/04

[52] U.S. Cl. ..... 241/207; 241/285.1; 241/286; 241/300

[58] Field of Search ..... 241/207, 208, 241/209, 210, 211, 212, 213, 214, 215, 216, 285.1, 299, 300, 286

[56] References Cited

U.S. PATENT DOCUMENTS

| | | | |
|---|---|---|---|
| 2,185,528 | 1/1940 | Stevens | 241/214 |
| 2,550,098 | 4/1951 | Traylor, Jr. | 241/209 |
| 2,680,571 | 6/1954 | Bjarme | 241/290 |
| 3,063,649 | 11/1962 | Pollak | 241/299 |
| 3,190,570 | 6/1965 | Symons | 241/215 |
| 3,459,383 | 8/1969 | De Diemar | 241/215 |
| 3,840,192 | 10/1974 | Hendrickson | 241/207 |
| 4,923,129 | 5/1990 | Chae | 241/207 |
| 5,163,213 | 11/1992 | Brizendine | 241/215 X |
| 5,769,340 | 6/1998 | Jean | 241/207 |

*Primary Examiner*—John M. Husar
*Attorney, Agent, or Firm*—Rosenberg, Klein & Bilker

[57] ABSTRACT

An improved positioning device for concaves of cone crushers including a supporting surface formed above a tapered inclined surface of a top cell and projecting inwardly, the supporting surface having slots symmetrically provided thereon for receiving and positioning lower positioning elements, and an annular flange disposed on the supporting surface. Opposite to the upper contact face of the supporting surface, the annular flange is provided with symmetrically distributed projections. Each projection is provided with a groove at a bottom edge thereof for receiving an upper positioning element mounted in place by a sunk-head bolt. A lower end face of the upper positioning element is configured to have a tapered surface that matches the respective one of the lower positioning elements. Furthermore, upper surfaces of the projections are provided with symmetrical key slots that are equivalent to the projections in number for mounting of stop blocks using sunk-head bolts. After mounting, the stop blocks project a certain distance from the key slots. The upper periphery of the concave is configured to have flange portions that are equivalent to the projections of the annular flange in number. After the concave has been installed, the flange portions urge against the sides of the stop blocks sideways.

2 Claims, 6 Drawing Sheets

POSITIONING DEVICE FOR CONCAVES OF CONE CRUSHERS

BACKGROUND OF THE INVENTION (a) Field of the Invention

The present invention relates generally to a positioning device for a concave of a hydraulic cone crusher, and more particularly to an improved positioning device which enables the concave of the cone crusher to become more tightly positioned with use. Besides, processing and assembly can be sped up, and the concave can be prevented from shaking.

(b) Description of the Prior Art

The concave of a conventional cone crusher is secured to the top cell by utilizing a U-shaped bolt. However, there are disadvantages in using such a securing method. The inventor of the present invention aimed to eliminate the disadvantages in U.S. Pat. No. 5,769,340 for "Positioning Device for Concave of Cone Crusher," in which the inclining surfaces of two contact surfaces to cooperate to enable the concave to become more and more secured with use.

Although the use of tabs and the configuration of inclining surfaces of the positioning device in the above-mentioned patent do enable the concave to become more secured with use, as the tabs are integrally formed with the concave during casting, it is difficult to process the inclining surfaces. Besides, it is also inconvenient to process the slots in the inner periphery of the top cell. Furthermore, assembly is also made difficult by the tabs provided below the concave.

In addition, referring to one of the embodiments in the above-mentioned patent, which is also directed to a hydraulic cone crusher, the concave is positioned by using tabs 51' provided at the bottom periphery of the concave, and a flange 10 is disposed above the bottom cell. However, a biggest drawback with such an arrangement is that the bottom cell 8 must be provided with an annular flange 82 in the inner wall, which limits the entire machine construction and makes casting and processing difficult. Besides, as the external diameter of the bottom edge of the concave 5' is larger, the diameter of the flange 10 cannot be increased with respect thereto, which not only makes casting and processing difficult but also obstructs assembly or maintenance. What's more, there are numerous types of cone crushers, and new models are being developed. Not every model of cone crusher is provided with an annular flange 82 at its bottom cell 8. Hence, the method of positioning the concave as disclosed in the prior art is limited to certain models that have an annular flange 82 provided at a bottom cell thereof. The range of application is therefore restricted. Hence, it is an aim of the present invention to improve upon the prior art to achieve a broader range of application and to facilitate assembly.

SUMMARY OF THE INVENTION

A primary object of the present invention is to provide a positioning device for a concave of a cone crusher, which facilitates assembly and maintenance.

Another object of the present invention is to provide a positioning device for a concave of a cone crusher, in which the concave is positioned directly on a top cell without urging against a bottom cell, so that the construction of the entire machine is improved to achieve higher crushing output.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
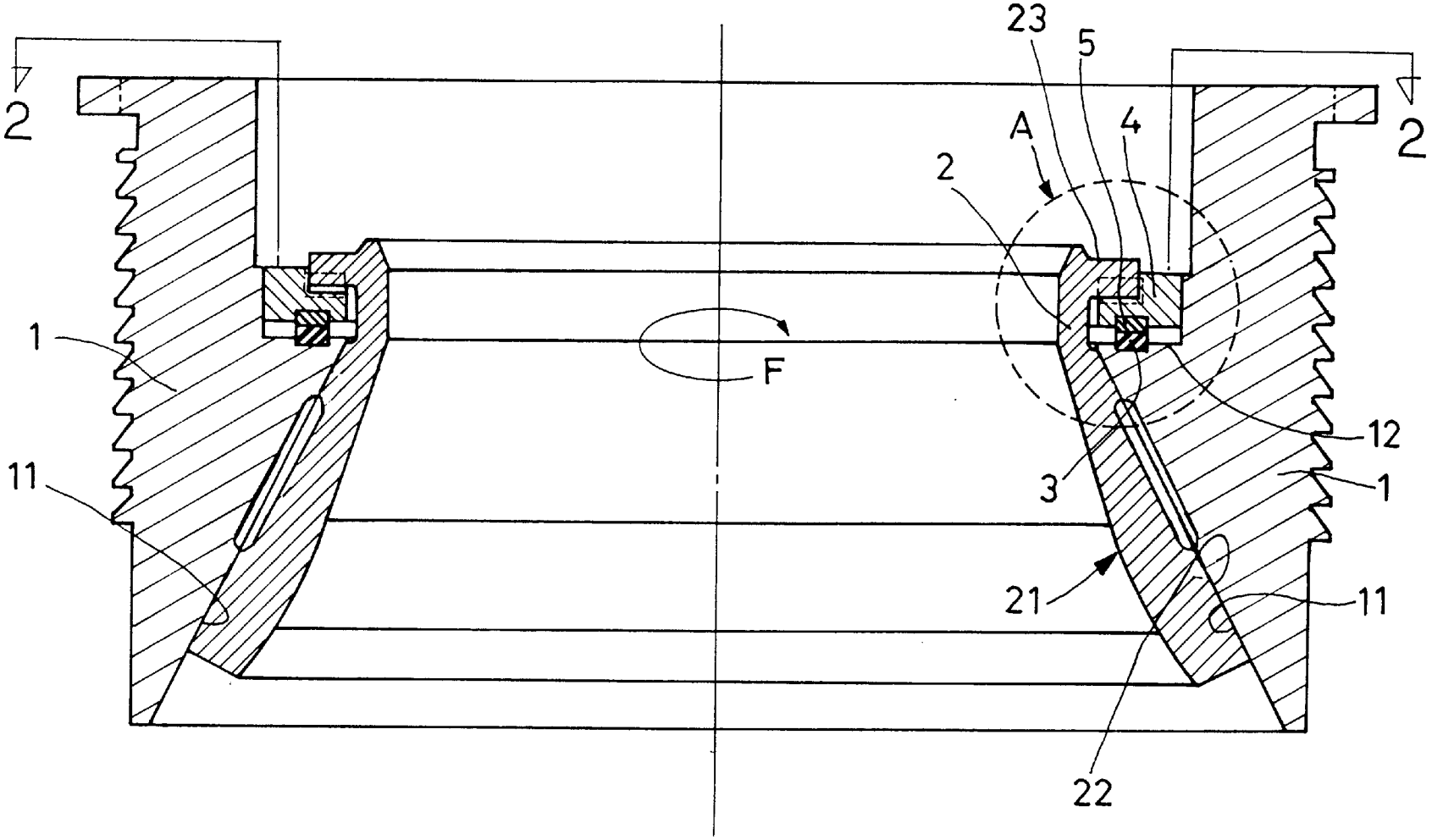
FIG. 1 is a sectional view of a preferred embodiment of the present invention.

Reference is made to FIGS. 1–6. As shown, the present invention comprises a top cell 1 that is substantially cylindrical and has an inner wall forming a tapered inclined surface 11 that has a smaller top portion and a larger lower portion; and a concave 2 that is a hollow conical structure with a smaller top portion and a larger lower portion, and has an inner wall 51 forming a working surface for crushing rocks, and an outer wall 22 shaped to match the inclined surface 11 of the top cell 1.

Figure 5:
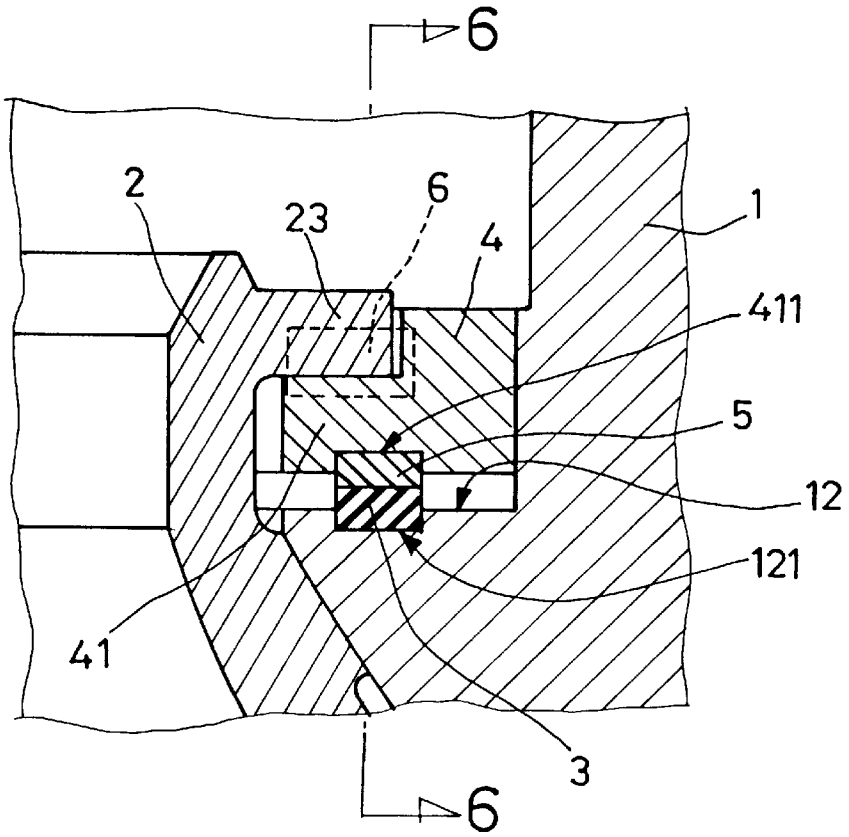
FIG. 5 is an enlarged schematic view of the part A in FIG. 1.

The present invention is characterized in that a supporting surface 12 is formed at an upper portion of the inclined surface 11 to project inwardly, as shown in FIGS. 1 and 5. The supporting surface 12 has slots 121 symmetrically formed thereon for receiving and positioning a lower positioning element 3 inserted therein. An upper end face of the lower positioning element 3 projects above the slots 121 and forms a tapered inclined surface 31. An annular flange 4 is disposed above the supporting surface 12 and provided with symmetrically distributed projections 41 on the surface in contact with the upper side of the supporting surface 12. A bottom edge of each projection 41 is provided with a groove 411 for receiving an upper positioning element 5 mounted in position by a sunk-head bolt 51. A lower end face of the upper positioning element 5 is configured to have a tapered inclined surface 52 for matching the lower positioning element 3. Furthermore, the upper surfaces of the projections 41 are provided with respective symmetrical key slots 42 that correspond to the projections 41 in number for mounting of stop blocks 6 using sunk-head bolts 61. After mounting, the stop blocks 6 project a certain distance from the respective key slots 42.

The upper periphery of the concave 2 is provided with flange portions 23 that are equivalent to the projections 41 of the annular flange 4 in number. After the concave 2 has been installed, the flange portions 23 urge against the sides of the above-mentioned stop blocks 6 sideways.

By means of the above-described arrangement, the concave 2 can be hoisted upwardly from the bottom face of the top cell 1, and the flange portions 23 on the upper side of the concave 2 are caused to turn towards the upper side of the projections 41 of the annular flange 4 to urge against the stop blocks 6, which compel the annular flange 4 to rotate according to the direction of rotation of the concave 2, further causing the upper positioning elements 5 on the bottom face of the annular flange 4 to come into contact fit with the lower positioning elements 3 on the upper side of the supporting surface 12. By utilizing the lower positioning elements 3 to support the annular flange 4 and the concave 2 thereon, the troublesome step of using screws to secure the concave can be eliminated, thus speeding up processing and assembly. Besides, the concave can be positioned firmly, and the positioning effect will become better and better with time.

Figure 2:
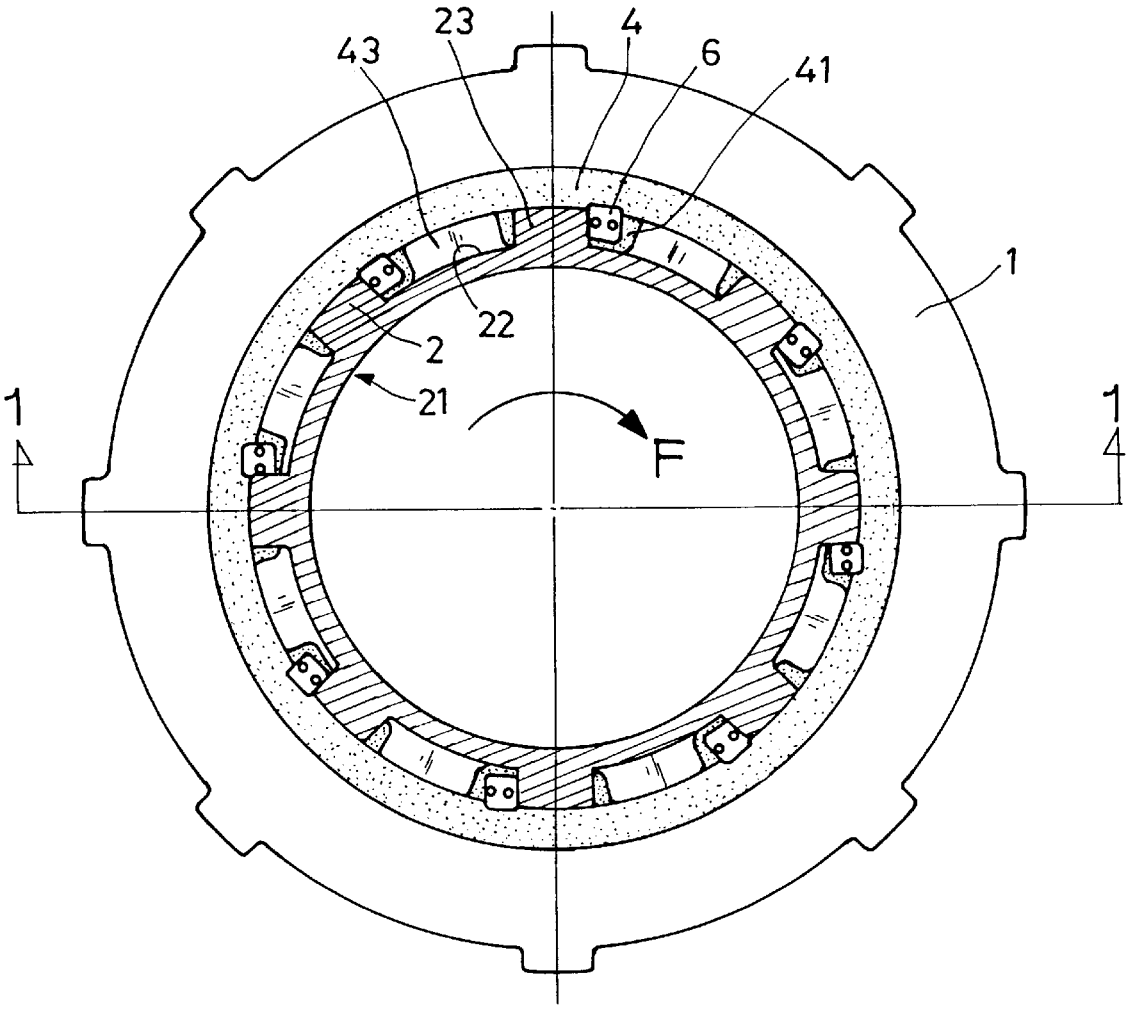
FIG. 2 is a sectional view taken along line 2—2 of FIG. 1.
Figure 3:
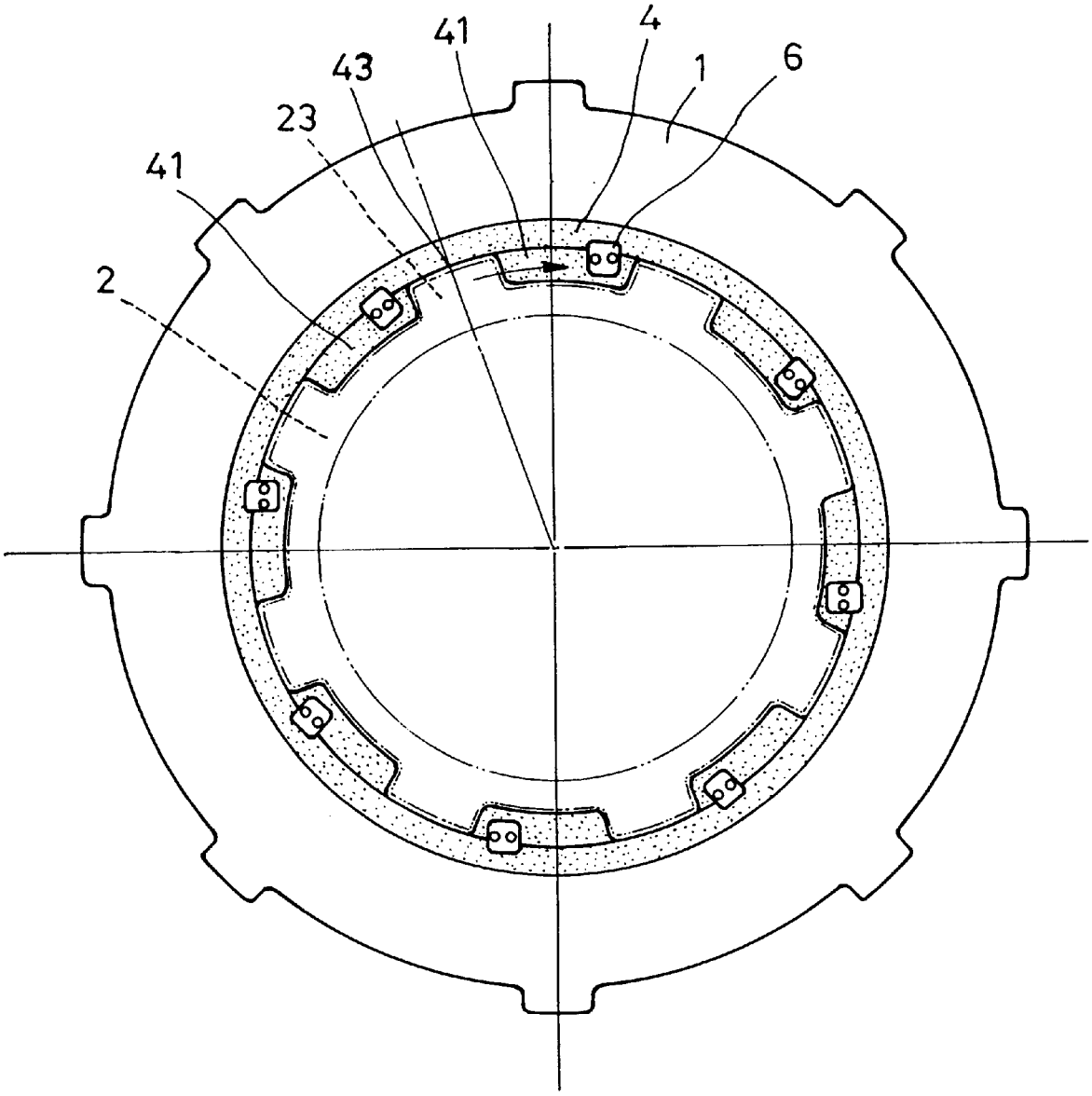
FIG. 3 is a top view of a top cell and a flange of the present invention.
Figure 4:
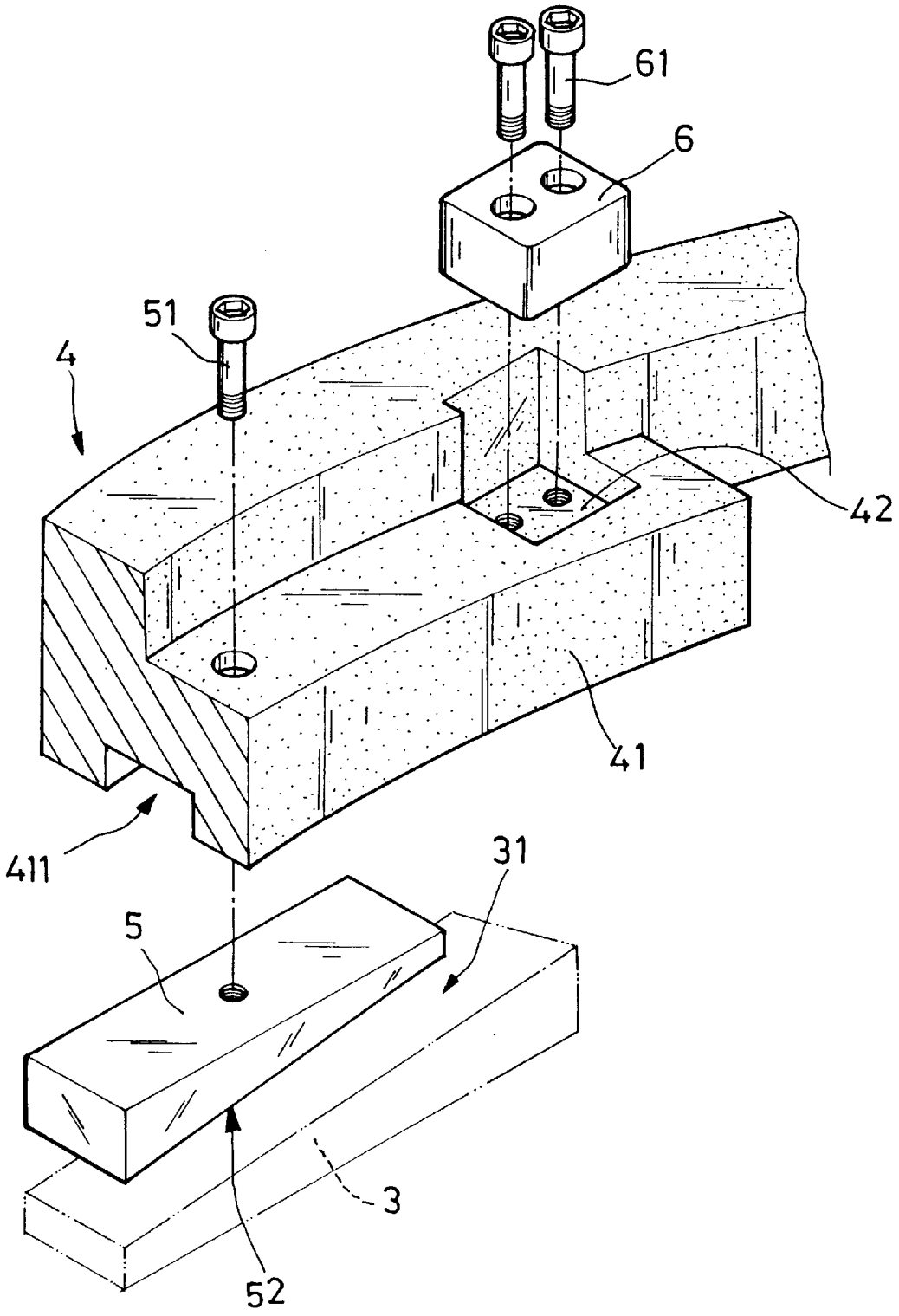
FIG. 4 is an exploded schematic view of the flange of the present invention.
Figure 6:
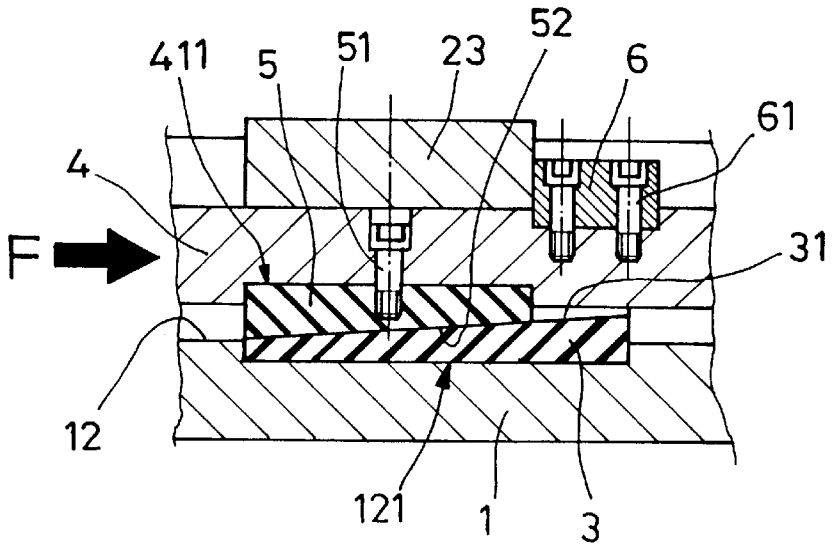
FIG. 6 is a schematic sectional view taken along line 6—6 of FIG. 5.
Figure 7:
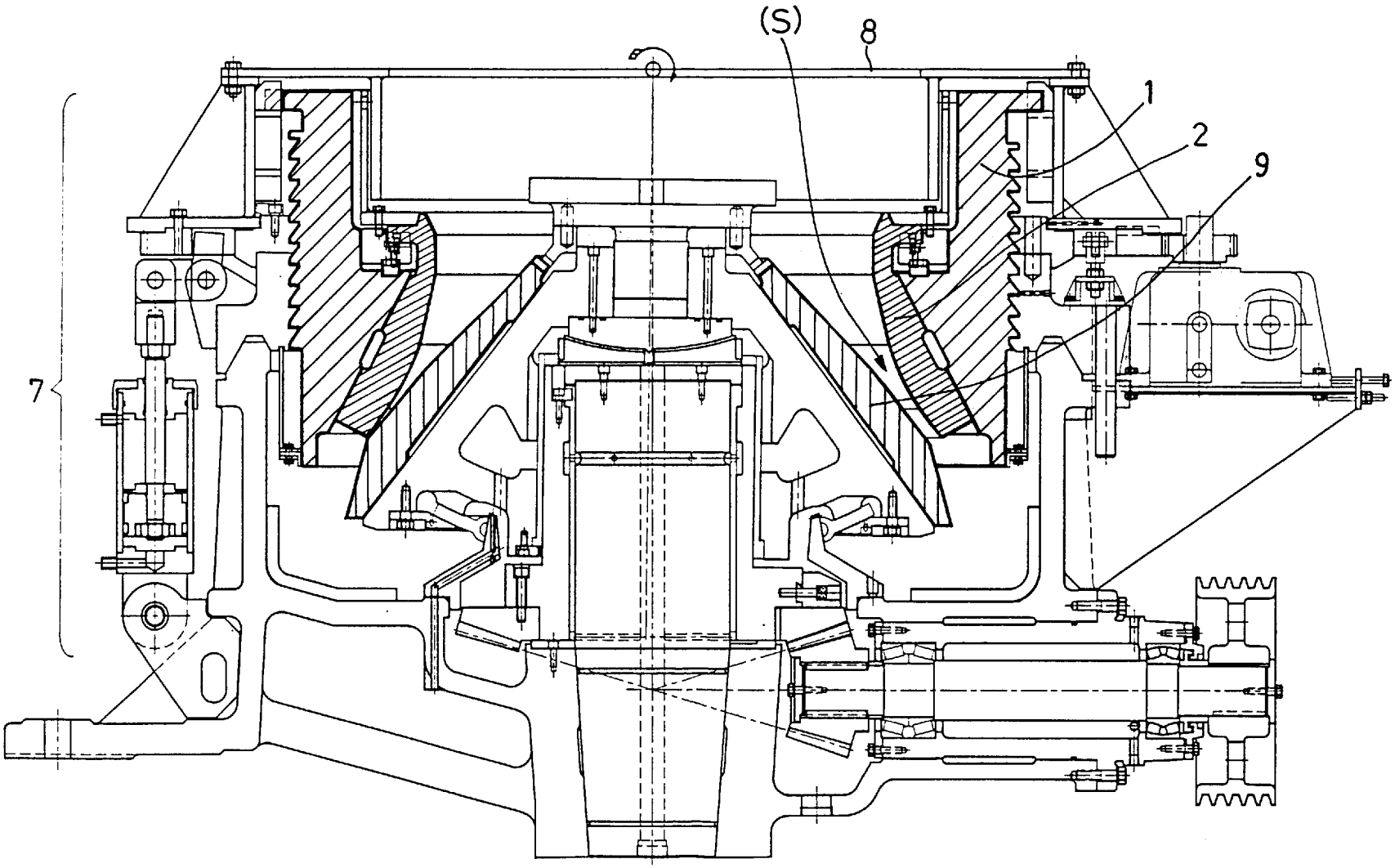
FIG. 7 illustrates the present invention in a state of use.

Assembly of the present invention is hereinafter described with reference to FIGS. 4, 5, and 6. First of all, the lower positioning elements 3 are insertably fitted into the slots 121, and sunk-head bolts 51, 61 are used to position the upper positioning elements 5 and the stop blocks 6 in the grooves 411 and key slots 42 of the annular flange 4 respectively. Then the annular flange 4 is placed on the supporting surface 12 of the top cell 1, so that the upper and lower positioning elements 5, 3 may come into contact. Next the flange is rotated in a counter-clockwise direction, so that the upper positioning elements 5 are lowered to a lowest position (as shown in FIG. 6). A top view of a construction as such is shown in FIG. 3. Referring to FIG. 3, an embodiment of the present invention is to leave depressed portions 43 between adjacent projections 41 of the annular flange 4, and the supporting surface 12 of the top cell 1 is likewise provided with depressions with respect to the depressed portions 43. Due to such a configuration, when the concave 2 is hoisted upwardly to be installed in the top cell 1, the flange portions 23 on the upper edge thereof can pass through at the positions of the depressed portions 43. And when the concave 2 is rotated in a clockwise direction, the flange portions 23 will be located above the projections 41 of the annular flange 4 to urge against the stop blocks 6. The state of the present invention after assembly is as shown in FIGS. 1 and 2. By this time, the concave 2 of the present invention is already properly positioned in the interior of the top cell, and the subsequently installation steps are to lock the top cell 1 in a cone crusher body 7, as shown in FIG. 7, and to mount the rest of the components (such as a top cell liner plate) in position to thereby accomplish a cone crusher. As the present invention is directed to a device for positioning the concave of the cone crusher, the other structural elements of the cone crusher are not discussed in detail herein. After assembly, the concave 2 is positioned on the outer periphery of the convex 9, and the clearance S therebetween is utilized to crush rocks.

Therefore, when the concave 2 is subjected to an acting force F going in a clockwise direction, as shown in FIGS. 1 and 2, it pushes the stop blocks 6, which transmit the force via the annular flange 4 to the upper positioning elements 5. Due to the urging relationship between the flange portions 23 and the stop blocks 6 of the annular flange 4, and due to the configuration of the tapered inclined surfaces 52, 31 between the upper positioning elements 5 on the bottom face of the annular flange 4 and the lower positioning elements 3 of the top cell 1, the positioning of the concave 2 will become tighter and tighter with use, which in turn causes the concave 2 to urge upwardly to couple more tightly and securely with the top cell 1.

In the present invention, since the processing and assembly work is proceeded on the top cell 1, there is no need to alter the structure of the cone crusher body 7. It can therefore be appreciated that the positioning is simpler and quicker, and the concave 2 can be prevented from shaking to ensure its normal function and to thereby protect the cone crusher against damage. Besides, costs can be reduced.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved positioning device for concaves of cone crushers, comprising:

a top cell that is substantially cylindrical and has an inner wall forming a tapered inclined surface that has a smaller top portion and a larger lower portion; and a concave that is substantially a hollow conical structure having a smaller top portion and a larger lower portion, and has an inner wall forming a working surface for crushing rocks, and an outer wall shaped to match said inclined surface of said top cell, wherein, a supporting surface is formed at an upper portion of said inclined surface to project inwardly, said supporting surface having slots symmetrically formed thereon for receiving and positioning respective lower positioning elements inserted therein, an upper end face of each of said lower positioning elements projecting above said slots and forming a tapered inclined surface, an annular flange being disposed above said supporting surface and provided with symmetrically distributed projections on the surface in contact with the upper side of said supporting surface, a bottom edge of each of said projections being provided with a groove for receiving an upper positioning element mounted in position by a sunk-head bolt, a lower end face of said upper positioning element being configured to have a tapered inclined surface for matching said tapered inclined surface of each of said lower positioning elements, the upper surfaces of said projections being provided with respective symmetrical key slots that correspond to said projections in number for mounting of stop blocks using sunk-head bolts, said stop blocks projecting a certain distance from said key slots after installation; and the upper periphery of said concave is provided with flange portions that are equivalent to said projections of said annular flange in number, said flange portions urging against the sides of said stop blocks sideways after installation of said concave, whereby said concave can be hoisted upwardly from the bottom face of said top cell, and said flange portions on the upper side of said concave are caused to turn towards the upper sides of said projections of said annular flange to urge against said stop blocks, compelling said annular flange to rotate according to the direction of rotation of said concave, further causing said upper positioning elements on the bottom face of said annular flange to come into contact fit with said lower positioning elements on the upper side of said supporting surface, said lower positioning elements being utilized to support said annular flange and said concave thereon to eliminate the use of screws to secure said concave and to speed up processing and assembly, the positioning of said concave becoming tighter and tighter with use.

2. An improved positioning device for concaves of cone crushers as defined in claim 1, wherein depressed portions are provided between adjacent projections of said annular flange, and said supporting surface of said top cell is likewise provided with depressions to allow passage of said flange portions on the upper periphery of said concave so that said flange portions can be positioned on said annular flange after being rotated.

* * * * *